US006964185B2

(12) United States Patent
Kruger et al.

(10) Patent No.: US 6,964,185 B2
(45) Date of Patent: Nov. 15, 2005

(54) APPARATUS FOR BENDING AND TRANSPORTING AN ALUMINUM SHEET

(75) Inventors: Gary A. Kruger, Troy, MI (US); John E. Carsley, Clinton Township, MI (US); Nelson T. Brinas, Sterling Heights, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 10/837,927

(22) Filed: May 3, 2004

(65) Prior Publication Data

US 2004/0200254 A1 Oct. 14, 2004

Related U.S. Application Data

(62) Division of application No. 10/269,631, filed on Oct. 11, 2002, now Pat. No. 6,776,020.

(51) Int. Cl.[7] ..... B21D 43/11

(52) U.S. Cl. ..... 72/422; 72/405.01; 414/751.1; 294/86.4

(58) Field of Search ..... 72/422, 405.09, 72/405.12, 405.01, 405.13, 295, 298, 308, 72/310; 414/752.1, 753.1, 751.1; 294/65, 294/86.4

(56) References Cited

U.S. PATENT DOCUMENTS

| | | | | | |
|---|---|---|---|---|---|
| 2,027,215 | A | | 1/1936 | Williams | 72/48 |
| 2,613,823 | A | * | 10/1952 | Johns | 414/626 |
| 4,441,354 | A | | 4/1984 | Bodega | 72/342.1 |
| 4,969,346 | A | | 11/1990 | Bosl et al. | 72/177 |
| 5,113,681 | A | | 5/1992 | Guesnon et al. | 72/53 |
| 5,206,981 | A | * | 5/1993 | Serafini | 29/243.57 |
| 5,249,447 | A | | 10/1993 | Aizawa et al. | 72/46 |
| 5,388,952 | A | * | 2/1995 | Hofele et al. | 198/375 |
| 5,452,981 | A | * | 9/1995 | Crorey et al. | 198/468.6 |
| 5,819,572 | A | | 10/1998 | Krajewski | 72/42 |
| 5,974,847 | A | | 11/1999 | Saunders et al. | 72/57 |
| 6,035,689 | A | | 3/2000 | Chang et al. | 72/379.4 |
| 6,047,583 | A | | 4/2000 | Schroth | 72/60 |
| 6,085,571 | A | | 7/2000 | Brinas et al. | 72/420 |
| 6,125,683 | A | * | 10/2000 | Toeniskoetter | 72/426 |
| 6,244,814 | B1 | * | 6/2001 | Herbermann et al. | 414/752.1 |
| 6,253,588 | B1 | | 7/2001 | Rashid et al. | 72/57 |
| 6,305,202 | B1 | | 10/2001 | Kleber | 72/57 |
| 6,497,130 | B2 | | 12/2002 | Nilsson | 72/252.5 |
| 6,502,447 | B2 | | 1/2003 | Adams et al. | 72/326 |

* cited by examiner

*Primary Examiner*—Daniel C. Crane
(74) *Attorney, Agent, or Firm*—Kathryn A. Marra

(57) ABSTRACT

A bending apparatus for bending and transporting an aluminum metal sheet. The bending apparatus includes a central retaining portion that has gripping elements mounted on the central retaining portion for retaining an aluminum metal sheet. There is also included a bending mechanism that is mounted to the central retaining portion. The bending mechanism is capable of axial movement in relation to a central axis of the central retaining portion for imparting a curvature to an aluminum metal sheet.

There is also included a method of stretch forming an aluminum metal sheet including the steps of heating an aluminum metal sheet in an oven, transferring the heat of an aluminum sheet to a hot forming tool, bending the heated aluminum sheet during the transfer step to conform the sheet to a shape of the hot forming tool, and then placing the bent metal sheet in the hot forming tool and forming an A-shaped part.

11 Claims, 3 Drawing Sheets

APPARATUS FOR BENDING AND TRANSPORTING AN ALUMINUM SHEET

This application is a division of application Ser. No. 10/269,631, filed Oct. 11, 2002, now U.S. Pat. No. 6,776,020.

TECHNICAL FIELD

This invention relates to a bending apparatus for bending and transporting an aluminum metal sheet, and more particularly to a bending apparatus for bending and transporting an aluminum metal sheet in a Super-plastic forming or Quick-plastic forming process.

BACKGROUND OF THE INVENTION

Automobile body panels are typically made by shaping low carbon steel or aluminum alloy sheet stock into desired panel shapes. Sheet panels may be made using conventional stamping technology or utilizing alternative methods such as Super-plastic forming (SPF) processes and Quick-plastic forming (QPF) processes. The above-referenced plastic forming processes have the advantage of creating complex shaped parts from a single sheet of material. Such plastic forming processes eliminate the need for joining several panels formed in a stamping process to create an overall panel assembly.

Super-plastic forming processes generally utilize a metal alloy, for example, aluminum and titanium alloys that have high ductility when deformed under controlled conditions. Such metal alloys are capable of extensive deformation under relatively low shaping forces. Super-plastic alloys are characterized by having tensile ductility in the range of from 200% to 1,000% elongation.

Super-plastic forming processes, such as that disclosed in U.S. Pat. No. 5,974,847 discloses a process in which an aluminum alloy 5083 sheet is heated to a desired SPF temperature of about 500° centigrade and then subjected to a stretch forming operation. The stretch forming operation includes placing the heated aluminum sheet in a tool that has upper and lower dies. The dies engage along the edges of the sheet and then high-pressure gas is introduced against the backside of the metal sheet through a suitable gas passage, stretching the metal sheet into compliance with the forming surfaces of the die. While the Super-plastic forming process allows for the creation of complex shaped parts, the process utilizes cycle times that may be too long for high volume manufacturing situations. The Super-plastic forming process also utilizes complex and expensive tooling that occupies a significant amount of space in a manufacturing facility.

Similarly, U.S. Pat. No. 6,253,588 discloses a Quick-plastic forming process in which large aluminum 5083 alloy sheets are formed into complex shaped parts at much higher production rates than those achieved by the SPF processes. The aluminum alloy sheets are heated to a forming temperature in the range of from 400° C. to 510° C. and are stretch formed against a forming tool utilizing high pressure gas against the back surface of the sheet. The fluid pressure is preferably increased continuously or stepwise from 0 psi to a final pressure of from 250 to 500 psi.

Complex parts produced utilizing the Quick-plastic forming process often use tooling that includes a binder that has a significant curvature to create the shape of the panel to be produced. With such curved binders, there is often a limited press opening that diminishes loading and accurately locating a flat blank sheet. To assist the forming operation and enable repeatable location of the blanks, the blank must often be bent to match the curvature of the binder. Current Quick-plastic forming processes utilize separate tooling inside a hot forming press for bending the blank to match the binder curvature. Such tooling occupies a significant amount of a manufacturing facility which could be utilized for additional forming tooling if the aluminum sheet could be bent to conform to the shape of the tool's binder.

There is, therefore, a need in the art to further optimize a Quick-plastic forming or Super-plastic forming process by eliminating tooling inside a hot forming press for pre-bending the blank to match the binder curvature. Such a process and an apparatus for carrying out the bending would realize significant cost savings when utilizing a Super-plastic forming or Quick-plastic forming operation.

SUMMARY OF THE INVENTION

There is disclosed a bending apparatus for bending and transporting an aluminum metal sheet that includes a central retaining portion. Gripping elements are mounted on the central retaining portion for holding an aluminum metal sheet. A bending mechanism is mounted on the central retaining portion. The bending mechanism is capable of axial movement in relation to a central axis of the central retaining portion for imparting a curvature to an aluminum metal sheet.

There is also disclosed a method of stretch forming an aluminum metal sheet that includes the steps of:

a) heating an aluminum metal sheet in an oven;

b) transferring the heated aluminum sheet to a hot forming tool;

c) bending the heated aluminum sheet during the transfer step (b) to conform the sheet to a shape of the hot forming tool;

d) placing the bent metal sheet in the hot forming tool and forming a shaped part.

The bending apparatus and method disclosed by the present invention has the advantage of providing a tool and method of pre-bending an aluminum blank sheet to match the curvature of a binder such that pre-bend tooling may be removed from the forming tool thereby allowing additional forming tooling to increase the overall efficiency of an operation.

The bending apparatus of the present invention also eliminates unbalanced loading of the hydraulic press associated with the forming tooling through the elimination of the pre-bending portion of the tooling.

The bending apparatus of the present invention has the additional advantage of providing pre-bent sheets to a forming tool which can improve the overall process by reducing press slide travel time and thus reducing heat loss of a heated forming tool.

DESCRIPTION OF THE PREFERRED EMBODIMENTS

In a first aspect of the invention, a bending apparatus for bending and transporting an aluminum metal sheet includes a central retaining portion 10 and gripping elements 15 mounted on the central retaining portion 10 for retaining an aluminum metal sheet 17. There is also included a bending mechanism 20 mounted on the central retaining portion 10. The bending mechanism 20 is capable of axial movement in relation to a central axis A—A of the central retaining portion 10 for imparting a curvature to an aluminum metal sheet 17.

Figure 1:
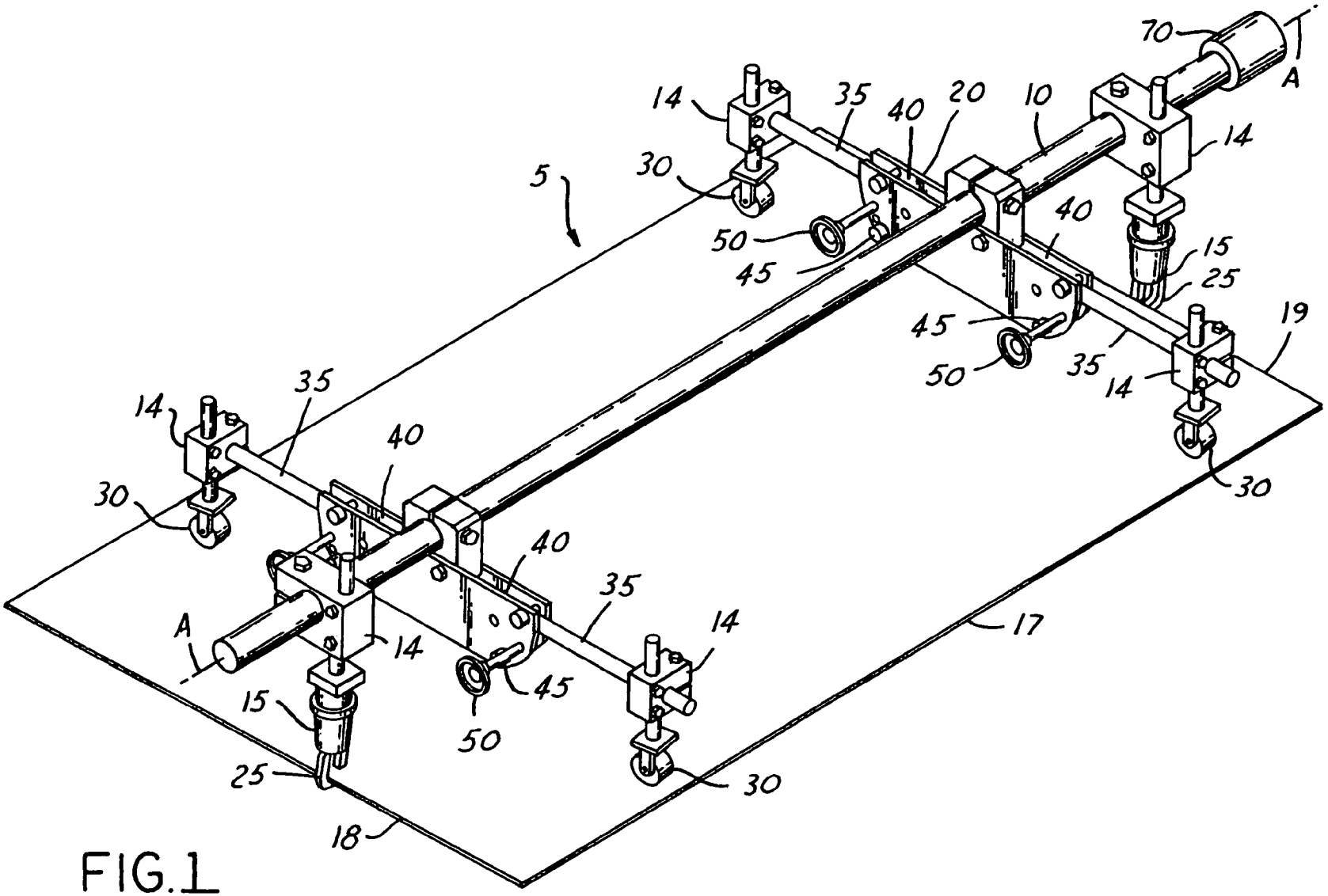
FIG. 1 is a perspective view of a first embodiment of the bending apparatus of the present invention.

With reference to FIG. 1, there is detailed a first embodiment of a bending apparatus 5 according to the present invention. There is shown a central retaining portion 10 having gripping elements 15 mounted at ends of the central retaining portion 10. The gripping elements are designed for retaining an aluminum metal sheet 17 without damaging the surface of the aluminum metal sheet 17. There is also included a bending mechanism 20 mounted on the central retaining portion 10. The bending mechanism 20 is capable of axial movement in relation to a central axis, shown as A—A, of the central retaining portion 10 for imparting a curvature to an aluminum metal sheet 17.

The gripping elements 15 preferably comprise a clamp mechanism 25 that releasably retains the aluminum metal sheet 17. The clamping mechanism 25 is designed such that it can withstand elevated temperatures associated with SPF or QPF processes, typically in the range of from 400° C. to 500° C. As can be seen in FIG. 1, the gripping elements 15 are mounted on the central retaining portion 10 utilizing suitable couplings 14. Again, with reference to FIG. 1, the gripping elements 15 grasp the aluminum metal sheet 17 along opposite edges 18, 19 defining a bend centerline for the aluminum metal sheet 17. The gripping elements 15 can be moved to varying positions along the edges 18, 19 of the aluminum metal sheet 17 such that varying bend contours can be obtained by moving a bend centerline of the aluminum metal sheet 17.

Again with reference to FIG. 1, there can be seen a preferred embodiment of the bending mechanism which includes rollers 30 disposed on pivoting arms 35. The bending mechanism 20 is mounted to the central retaining portion 10 utilizing appropriate couplings 14. The bending mechanism 20 also includes bearings 40 that are coupled to the pivoting arms 35 and allow for movement relative to the central retaining portion 10. The rollers 30 are attached to the pivoting arms 35, again using suitable couplings 14. The rollers 30 are moveable along the pivoting arms 35 such that varying curvatures can be imparted to the aluminum metal sheet 17.

The bending mechanism 20 also includes limiting elements 45 associated with the bearing 40 for limiting a range of motion of the pivoting arms 35. The bending mechanism of a first embodiment further includes a quick release mechanism 50 that frees the pivoting arms 35 from an initial position, as shown in FIG. 2 and allows the pivoting arms 35 to travel through a range of motion and impart a curvature to an aluminum metal sheet 17, as shown in FIG. 3.

The pivoting arms 35 move axially with respect to the central retaining portion 10 due to the weight of the pivoting arms 35 and rollers 30, as well as the influence of gravity.

Figure 2:
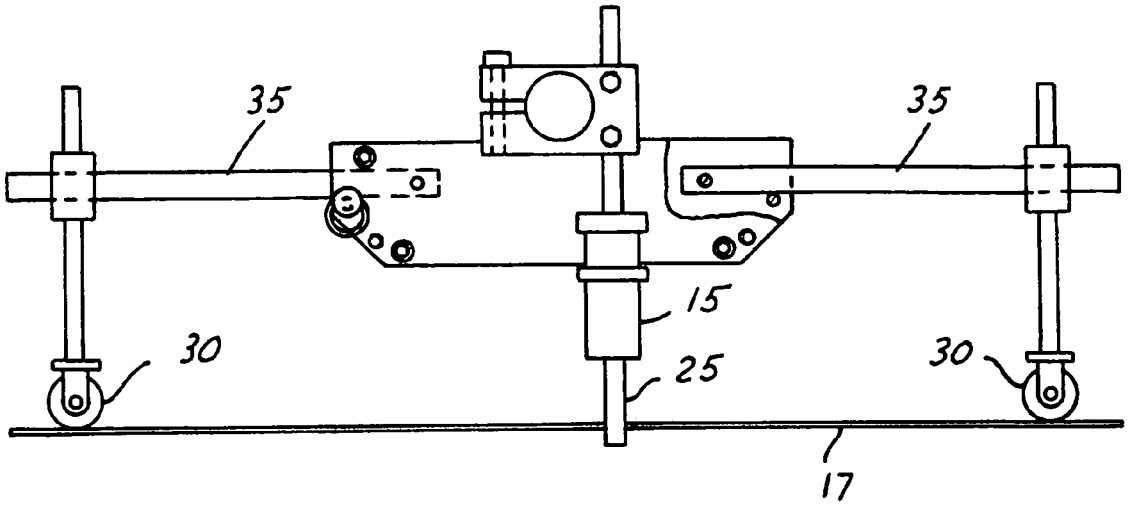
FIG. 2 is an end view of a first embodiment detailing the bending apparatus of the present invention.
Figure 3:
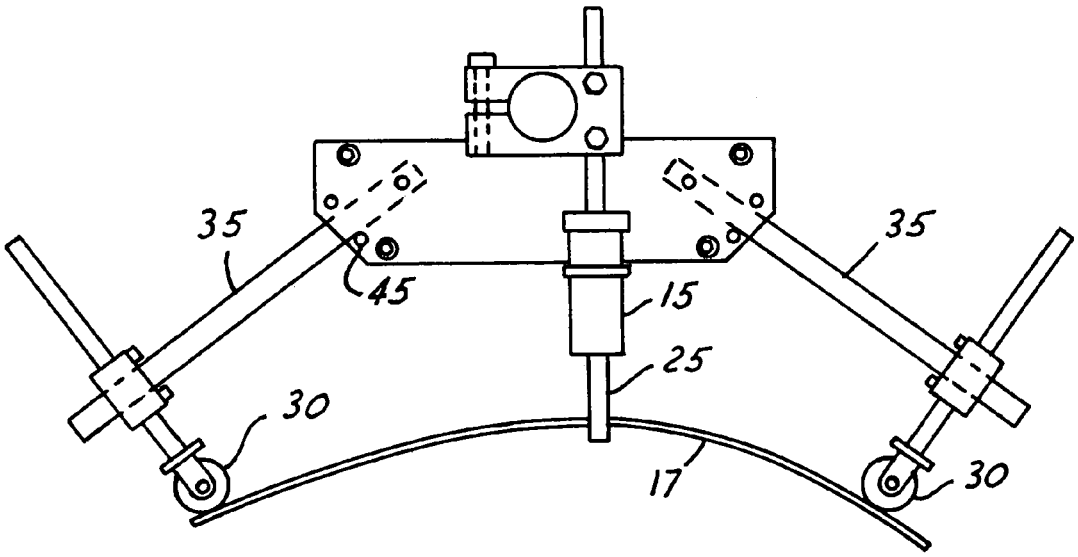
FIG. 3 is an end view of a first embodiment detailing the bending arms in an actuated position bending an aluminum sheet.

Therefore, a planar aluminum metal sheet 17, as shown in FIG. 2 is held by the gripping elements 15 of the bending apparatus 5. The quick release pins 50 are removed to allow for movement of the pivoting arms 35 and rollers 30 with respect to the central axis A—A of the central retaining portion 10. The weight of the pivot arms 35 and rollers 30, as well as the influence of gravity moves the pivoting arms 35 axially and imparts a curvature to the heated aluminum metal sheet 17, as can be seen in FIG. 3. The pivoting arms 35 are allowed to move through a range of motion until they contact the limiting elements 45 thereby stopping their movement.

The bending apparatus 5 also includes a coupling collar 70 for attachment to a manual-assist device. Typical manual-assist devices generally include standard material handling equipment such as: robots, pick-and-place devices, and manual-assist devices such as a Zimmerman tool.

Figure 4:
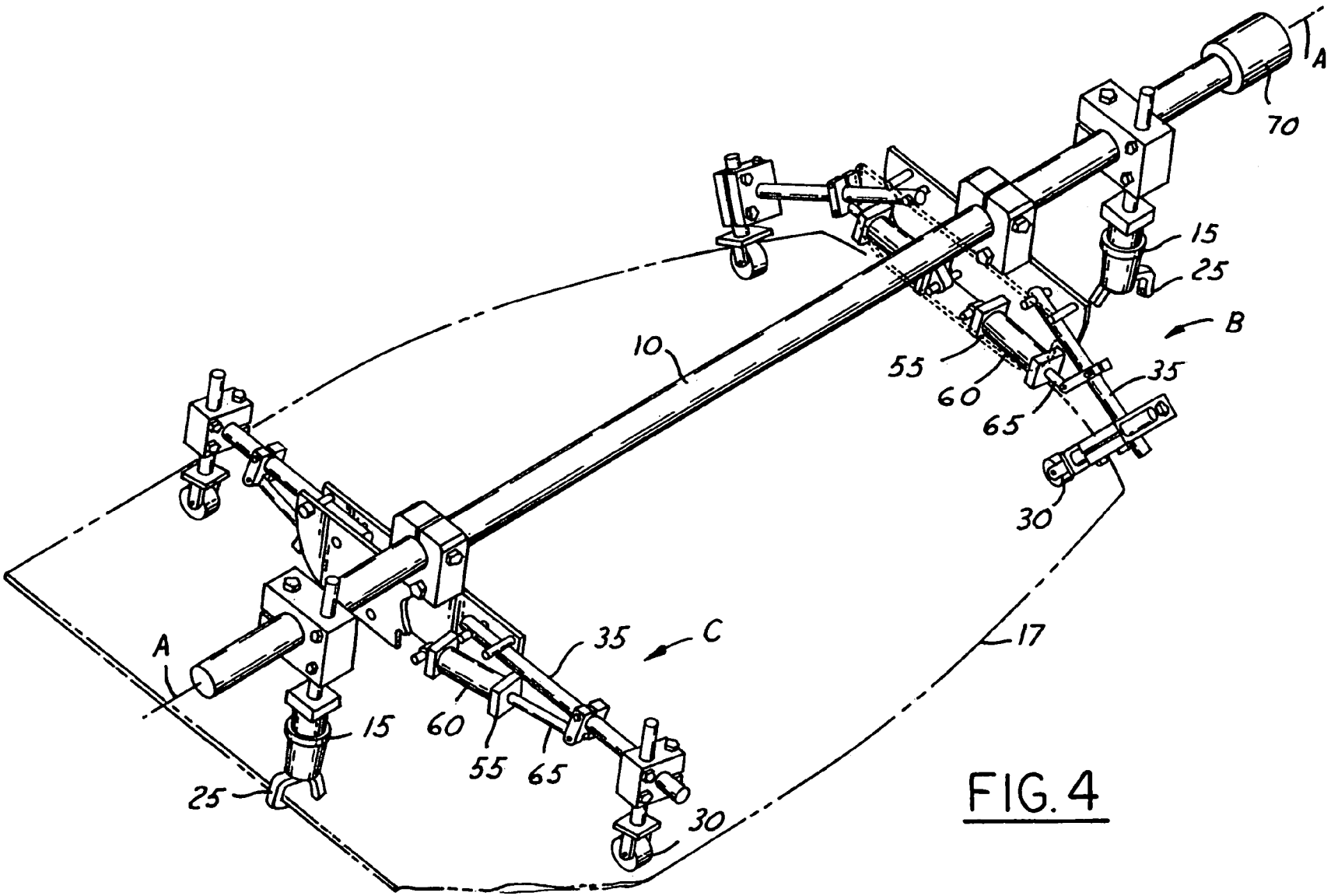
FIG. 4 is a perspective view of a second embodiment of the bending apparatus of the present invention.

With reference to FIG. 4, there is shown a second embodiment of the bending apparatus 5 of the present invention. The second embodiment is similar to that of the first embodiment in all respects, but includes a mechanical assistance mechanism 55 for actuating the pivoting arms 35 from an initial position through a range of motion. In a preferred aspect of the invention, the mechanical assistance device comprises a pneumatic cylinder device 60 coupled to the pivoting arm 35 and the central retaining portion 10. The pneumatic cylinder device 60 includes a piston 65 that is retractable within the cylinder 60 such that movement of the piston 65, that is coupled to the pivoting arm 35, can vary the travel path of the pivoting arm 35. Air lines associated with the pneumatic cylinder 60 should be designed to withstand the heat associated with the SPF and QPF processes disclosed above.

With reference to FIG. 4, the pivoting arm 35 is shown in its initial position designated as the letter C. As can be seen, the piston 65 of the pneumatic device 55 is extended in relation to the pneumatic cylinder 60. When the mechanical assistance mechanism 55 is actuated, the piston 65 is drawn within the cylinder 60 causing the pivoting arm 35 to move through a range of motion, as is designated by the letter B. In this manner, the pivoting arms 35 move axially with respect to the central retaining portion 10 thereby causing the rollers 30 to interact with the heated aluminum sheet 17 and impart a curvature to the aluminum metal sheet 17.

Although the mechanical assistance mechanism 55 has been described with respect to a pneumatic cylinder device 60, other mechanical assistance mechanisms 55 including hydraulic, electrically-actuated, or other known servo-mechanical assistance mechanisms may be utilized without departing from the inventive aspect of the bending apparatus 5.

There is also disclosed, as an aspect of the present invention, a method of stretch forming an aluminum metal sheet that includes the steps of:

a) heating the aluminum metal sheet in an oven, b) transferring the heated aluminum sheet to a hot forming tool, c) bending the heated aluminum sheet during the transfer step such that it conforms to the shape of the hot forming tool, and d) then placing the bent metal sheet in the hot forming tool and forming a shaped part.

The aluminum metal sheet associated with the process preferably comprises a Super-plastic aluminum alloy, as that disclosed in U.S. Pat. No. 5,974,847 and U.S. Pat. No. 6,253,588 which are herein incorporated by reference. The method utilized to form a shaped part includes: Super-plastic forming and Quick-plastic forming procedures as described in the above-referenced patents.

Again to reiterate, by heating the aluminum metal sheet in an oven that is external to the hot forming tool, the hot forming tool does not have to include tooling for pre-bending the aluminum metal sheet to a binder shape of the hot forming tool. Rather the aluminum metal sheet is bent while being transferred from the oven to the hot forming tool thereby providing a significant cost savings with respect to the hot forming tool. By pre-bending the aluminum metal sheet, the pre-bent aluminum sheet may be repeatedly located in the hot forming tool, thereby increasing the overall efficiency of a stretch forming operation.

While preferred embodiments are disclosed, a worker in this art would understand that various modifications would come within the scope of the invention. Thus, the following claims should be studied to determine the true scope and content of this invention.

What is claimed is:

1. A bending apparatus for bending and transporting an aluminum metal sheet comprising:

a central mounting member;

a plurality of gripping elements attached to the central mounting member;

a plurality of roller elements attached to pivoting arms moveably retained on the central mounting member;

the plurality of rollers for interacting with a heated aluminum metal sheet to impart a curvature to the aluminum metal sheet.

2. The bending apparatus of claim 1 wherein the gripping elements comprise a clamp mechanism that releasably retains the aluminum metal sheet.

3. The bending apparatus of claim 2 wherein the gripping elements grasp the aluminum metal sheet along opposite edges thereby defining a bend centerline for the aluminum metal sheet.

4. The bending apparatus of claim 1 wherein the rollers are moveable along the pivoting arms for adjusting the curvature imparted to the aluminum metal sheet.

5. The bending apparatus of claim 1 wherein the pivoting arms are coupled to bearings that are attached to the central mounting member.

6. The bending apparatus of claim 1 wherein the bending apparatus further includes limiting elements for bounding a range of motion of the pivoting arms.

7. The bending apparatus of claim 1 wherein the bending apparatus further includes a quick release mechanism for freeing the pivoting arms from an initial position and allowing the pivoting arms to travel through the range of motion.

8. The bending apparatus of claim 1 wherein the bending apparatus further includes a mechanical assistance mechanism for actuating the pivoting arms from an initial position through a range of motion.

9. The bending apparatus of claim 8 wherein the mechanical assistance device is selected from the group consisting of pneumatic, hydraulic, electrical and servo-mechanical devices coupled to the pivoting arm and the central mounting member.

10. The bending apparatus of claim 8 wherein the mechanical assistance device comprises a pneumatic cylinder device coupled to the pivoting arm and the central mounting member.

11. The bending apparatus of claim 10 wherein the pneumatic cylinder device includes a piston retractable within the cylinder and coupled to the pivoting arm for applying a curvature to the aluminum metal sheet.

* * * * *